US005491499A

United States Patent [19]

Bibbe et al.

[11] Patent Number: 5,491,499

[45] Date of Patent: Feb. 13, 1996

[54] INKJET NOZZLE FOR AN INKJET PRINTER

[75] Inventors: Christiaan P. M. Bibbe; Martinus J. Hester, both of Boxmeer; Wilhelmus J. C. Prinsen, Winssen; Fransiscus J. M. van de Weyer, Boxmeer, all of Netherlands

[73] Assignee: Stork X-Cel B.V., Boxmeer, Netherlands

[21] Appl. No.: 730,977

[22] PCT Filed: Jan. 17, 1990

[86] PCT No.: PCT/NL90/00006

§ 371 Date: Jan. 28, 1991

§ 102(e) Date: Jan. 28, 1991

[87] PCT Pub. No.: WO90/08038

PCT Pub. Date: Jul. 26, 1990

[30] Foreign Application Priority Data

Jan. 20, 1989 [NL] Netherlands ..... 8900146

[51] Int. Cl.[6] ..... B41J 2/14

[52] U.S. Cl. ..... 347/47; 347/75

[58] Field of Search ..... 346/75, 140 R; 239/102.2; 347/47, 73, 74, 75

[56] References Cited

U.S. PATENT DOCUMENTS

| | | | |
|---|---|---|---|
| 3,708,118 | 1/1973 | Keur | 346/75 X |
| 3,823,408 | 7/1974 | Gordon, III | 346/140 R |
| 4,065,774 | 12/1977 | Lee | 346/140 R |
| 4,228,440 | 10/1980 | Horike et al. | 346/75 |
| 4,296,417 | 10/1981 | Markham et al. | 346/75 |
| 4,417,255 | 11/1983 | Furukawa | 346/75 |
| 4,623,904 | 11/1986 | Conta et al. | 346/140 R |
| 4,714,936 | 12/1987 | Helinski et al. | 346/140 R |
| 4,727,379 | 2/1988 | Sourlis et al. | 346/75 |

FOREIGN PATENT DOCUMENTS

| | | | |
|---|---|---|---|
| 3123689 | 12/1982 | Germany . | |
| 58-163667 | 9/1983 | Japan . | |
| 62-151347 | 7/1987 | Japan | 347/47 |
| 63-5949 | 1/1988 | Japan . | |

OTHER PUBLICATIONS

"Ink Jet Nozzle Fabrication", IBM Corp., Technical Disclosure Bulletin, vol. 20, No. 11A, Apr. 1978, p. 4485.

*Primary Examiner*—Benjamin R. Fuller
*Assistant Examiner*—Alrick Bobb
*Attorney, Agent, or Firm*—Bell, Seltzer, Park & Gibson

[57] ABSTRACT

An inkjet nozzle for an inkjet printer which is adapted to operate in the continuous inkjet mode, and which comprises a housing 1 having an ink supply channel 2 extending therethrough. The downstream end of the ink supply channel 2 is closed by a separate thin flat plate 7 which is fixed to the outlet end of the housing, and the plate includes an outflow channel 8 therethrough which is coaxially aligned with the ink supply channel. The outflow channel 8 has a very small diameter as compared to the diameter of the adjacent portion of the ink supply channel through the housing, and the length of the outflow channel is greater than its diameter. Also, an ultrasonic vibration element 12 is mounted to the exterior of the housing at a location adjacent the outlet end.

10 Claims, 1 Drawing Sheet

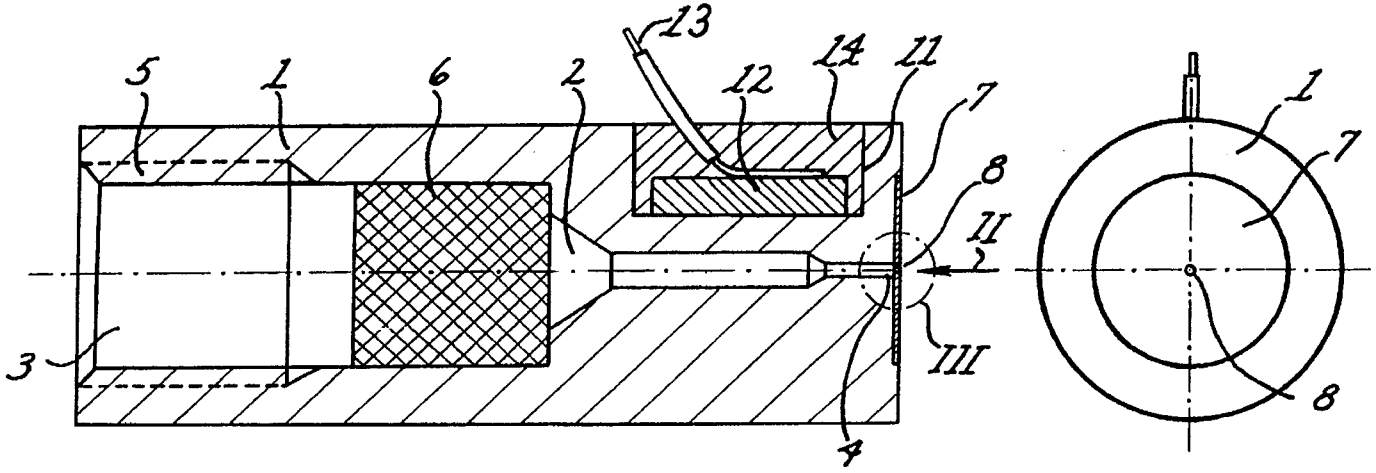
FIG. 1.
FIG. 2.
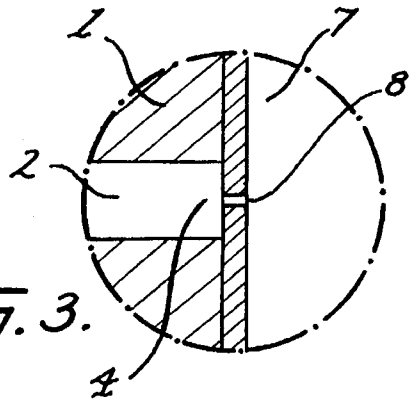
FIG. 3.
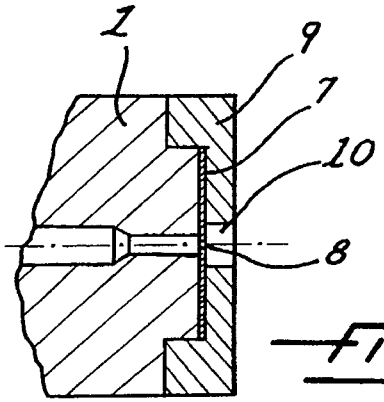
FIG. 4.

INKJET NOZZLE FOR AN INKJET PRINTER

The present invention relates to an inkjet nozzle for an inkjet printer.

Inkjet printers generally have at least one inkjet nozzle and an ink supply system which supplies ink at a suitable pressure to the inkjet nozzle. The ink is forced out of an outflow aperture and injected in the form of a series of small drops of equal size onto a substrate, such as a sheet of paper. The ink drops pass a charging electrode where the drops are selectively provided with an electric charge, and then pass a pair of deflections plates. The charged drops are deflected as a reaction to a voltage which is applied to the deflection plates, so that the drops either go onto the substrate or are deflected and collected. The collected ink can be recirculated to the supply system.

Inkjet printers can work according to two different principles, the continuous inkjet principle and the drop on demand principle. In the continuous inkjet principle, an inkjet is generated by forcing ink at high pressure through an inkjet nozzle. The pressure lies between 20 and 60 bar. This products an inkjet which by means of excitation is converted into a series of small ink drops which hit the substrate at high velocity. The number of drops which is generated lies between 100,000 and 2,000,000 drops per second. In this case of the drop on demand principle, an inkjet is not generated under high pressure, but individual drops are generated and discharged onto the substrate. This technique is characterized by a low pressure (2–10 bar) which is offered in the form of pulses. The number of drops generated lies between 1,000 and 30,000 drops per second.

In inkjet nozzles for the continuous inkjet principle, drop information is generally stimulated by an ultrasonic vibration element which produces a high-frequency vibration. The pressure pulse needed for drop formation is 0.1% of the working pressure. For a working pressure of 30 bar, this is approximately 0.03 bar, which is very small compared with inkjet printers operating by the drop on demand principle, where the pressure pulses are a hundred times that.

IBM-Technical Disclosure Bulletin, Vol. 20, No. 11A, April 1978, p 4485 "Inkjet nozzle fabrication" by J. M. Huellemeier et al. discloses an inkjet nozzle for an inkjet printer comprising a housing made of an essentially undeformable material and containing an ink supply channel, which at its outflow end is closed by an end wall which is fixed to the housing and which is provided with an ink outflow channel lying in line with the ink supply channel. This known inkjet nozzle has no vibration element and the document is silent about the dimensions of the ink outflow channel.

The object of the invention is to provide an improved inkjet nozzle for an inkjet printer working on the continuous inkjet principle.

According to the invention this object is attained by an inkjet nozzle comprising a housing made of an essentially undeformable material and containing an ink supply channel, which at its outflow end is closed by an end wall which is fixed to the housing and which is provided with an ink outflow channel lying in line with the ink supply channel, wherein the housing of the inkjet nozzle is essentially block-shaped, the outflow channel has a diameter between 3 and 30 microns (μm) and a length which is 3 to 30 times greater than its diameter, and near the outflow end of the ink supply channel the housing is provided with an ultrasonic vibration element.

The inkjet nozzle according to the invention is sturdy, of compact construction, and stable during use. During use it produces a stable inkjet consisting of a series of small ink drops with reproducible characteristics. The inkjet nozzle is also reliable and easy to clean.

U.S. Pat. No. 4,228,440 describes an inkjet nozzle for an inkjet printer comprising a housing containing an ink supply channel which at its outflow end is closed by an end wall which is fixed to the housing and which is provided with an ink outflow channel lying in line with the ink supply channel. The inkjet nozzle is further provided with a plurality of ultrasonic vibrators. The vibrators are not provided near the outflow end of the ink supply channel. Moreover, the document is silent about the dimensions of the ink outflow channel.

Preferred embodiments of the inkjet nozzle according to the invention are claimed in the subclaims.

The invention will now be explained in greater detail in the example of an embodiment which follows, with reference to the drawings, in which:

FIG. 1 is a longitudinal section of the inkjet nozzle according to the invention;

FIG. 2 is a front view of the inkjet nozzle of FIG. 1, in the direction of the arrow II;

FIG. 3 shows the detail III of the inkjet nozzle of FIG. 1 at the outflow channel, on an enlarged scale; and FIG. 4 shows an end part of a modified embodiment of the inkjet nozzle according to the invention.

The inkjet nozzle shown in FIGS. 1 and 2 for an inkjet printer working on the continuous inkjet principle comprises a slightly oblong-shaped cylindrical housing 1 in which an ink supply channel 2 is fitted concentrically. The ink supply channel 2 has a diameter which decreases in stages from the inflow end 3 towards the outflow end 4. At the inflow end 3 the ink supply channel 2 is provided with, for example, an internal screw thread 5, so that the inkjet nozzle can be screwed onto an ink supply line (not shown here). A filter 6 for filtering the ink flowing through the channel is fitted in the ink supply channel 2.

At the outflow end 4 the ink supply channel 2 is provided with an end wall in the form of a separate thin plate 7, which is fixed to the housing 1, and which is provided with an outflow channel 8 of very small diameter which is disposed essentially concentrically relative to the ink supply channel 2. The diameter of the ink supply channel 2 must be small at the outflow end 4, in order to keep the forces on the plate 7 as low as possible during operation. This diameter preferably lies between 0.2 and 1 mm. The diameter of the ink supply channel 2 at the outflow end 4 is, however, many times Greater than the diameter of the outflow channel 8 (see also FIG. 3). The diameter of the outflow channel 8 is, for example, between 3 and 30 microns, and is preferably between about 6 and 20 microns. The outflow channel 8 has to be sufficiently long to obtain a stable direction of the ink jet. On the other hand, the outflow channel 8 must be as short as possible in order to prevent high-frequency vibrations, which—as will be discussed in greater detail below—for the formation of drops are transferred to ink flowing through the outflow channel, from being too greatly damped, which would adversely affect the reproducibility of the drop, formation.

The housing 1 of the jet nozzle is preferably made of stainless steel. The housing 1 can, however, also be made of less corrosion-resistant material if it is provided with a coating on the inside, for example a coating applied chemically by evaporation. The coating must cover completely, be free from holes, and be corrosion-resistant. Furthermore, this coating must not affect the properties of the ink. The housing could possibly be made of a non-swelling plastic. In addition, a ceramic material can also be used.

In the jet nozzle shown the housing 1 is in the form of a slightly oblong-shaped cylinder. The housing can, however, also be a different shape. It can also be provided with a fitting face (not shown here) for aligning the jet nozzle, and said fitting face can be disposed in the outside wall of the housing by grinding. The housing 1 is, for example, 20 mm long and 8 mm in diameter.

The filter 6 is preferably made of stainless steel with a transmission factor of 3 microns. The filter 6 can, if necessary, also be made of polytetrafluoroethylene or glass.

The thin plate 7 is preferably made of glass, but can also be made of all kinds of other materials, such as ruby, sapphire, stainless steel, nickel, platinum etc. The thickness of the plate 7 is, for example, about 100 microns (0.1 mm).

In view of the small diameter of the ink supply channel, the plate 7 with the outflow channel 8 must be fitted very accurately. The connection of the plate 7 to the housing 1 must be such that the forces on the plate 7 are as low as possible during operation. Great forces lead to deformation of the plate 7, with repercussions for the direction of the jet, or even leading to breaking or cracking of the plate.

In the embodiment of FIGS. 1 and 2 the plate 7 is centred in a recess, and fixed on the housing 1 by means of, for example, a thermosetting two-component epoxy adhesive. The adhesive layer must be very thin, while the faces of the housing 1 and the plate 7 to be glued must be very flat. The adhesive must be metered very accurately, in order to:

prevent adhesive from going into the ink supply channel 2 and blocking the outflow channel, keep the surface of plate 7 which is non glued, and which is exposed to high pressures, as small as possible.

In the embodiment of FIG. 4 the plate 7 centred by means of a cap 9, in which the plate 7 lies, and which is provided with an aperture 10, in such a way that the outflow channel 8 in the plate 7 lies free. The cap 8 is fixed to the housing 1.

The embodiment of FIG. 4 is an alternative to the fastening form of FIG. 1. Here again the surface area of the plate 7 exposed to the high pressure must be kept as low as possible. If the plate 7 is made of an undeformable material, such as glass, it cannot be clamped, but must be bonded with adhesive. In that case the same requirements as those for the embodiment of FIG. 1 apply for the bonding.

In the jet nozzle shown in FIGS. 1 and 2, the housing 1 has formed in it, near the outflow end 4 of the ink supply channel 2, a recess 11 in which an ultrasonic vibration element, for example a piezoelectric crystal 12, is fitted. This vibration element 12 is used to set the ink jet coming out of the outflow aperture 8 in vibration. The piezoelectric crystal can be, for example, a lead/zirconate/titanate crystal 5 mm in cross section and 1 mm thick. The piezoelectric crystal 12 is provided with electrical connecting wires 13. A thermosetting two-component epoxy adhesive can be used for fixing the piezoelectric crystal 12 on the housing 1. The recess 11 can also be filled with a filler 14, for example epoxy.

Due to the rigid construction of the housing 1, the ultrasonic vibration element 12 can be fitted parallel to the ink supply channel 2, as shown in FIG. 1. This has the following advantages compared with an ultrasonic vibration element which is fitted round the ink supply channel:

The adhesive connection between the ultrasonic vibration element 12 and the housing 1 can be made very reproducible, because the faces to be bonded can be pressed very well onto each other. The ultrasonic vibration is consequently transferred virtually undamped via the adhesive connection to the housing. (The adhesive layer in fact acts as a damper here. ) Good reproducibility of the adhesive connection is essential for good drop formation.

There is no need to make a hole in the ultrasonic vibration element, something which is necessary in the case of a coaxial position relative to the ink supply channel.

The jet nozzle according to the invention has the following advantages:

It is compact and snort;

It is sturdy (which is an advantage for handling and cleaning D;

It is relatively cheap to produce;

It can withstand very high pressure (e.g. 120 bar);

The front side is easy to polish, which is an advantage for cleaning and provides an improvement in the wetting properties, in particular where a glass plate is used;

Where a metal housing is used, the electrical shielding of the ink (against electrostatic fields which interfere with the charge) is excellent;

Due to the easy workability of stainless steel (or other materials from which the housing can be made), variations in the shape (alignment faces) can easily be made; embodiments with very small dimensions are also easy to produce;

In terms of time, the direction of the ink jet is very stable; after adjustment, re-alignment is no longer necessary;

The mechanical stability is very good;

Due to the shape of the ink supply channel, there is any drying out of the ink, the residue is very easy to remove.

The overall design of the jet nozzle according to the invention also has the great advantage that the number of drops generated per second, assuming the same electrical vibration offered to the ultrasonic vibration element, is the same within very narrow tolerances for different jet nozzles.

We claim:

1. An inkjet nozzle for an inkjet printer comprising a housing (1) made of an essentially undeformable material and defining an inlet end (3) and an opposite outlet end (4), an ink supply channel (2) extending through said housing and between said inlet and said outlet end, said ink supply channel including a first cylindrical portion of relatively large diameter adjacent said inlet end and a second cylindrical portion of relatively small diameter adjacent said outlet end, the diameter of said second cylindrical portion of said ink supply channel being between about 0.2 to 1 mm, a separate thin flat plate (7) fixed to said outlet end of said housing so as to close said second cylindrical portion of said ink supply channel, said plate including an outflow channel (8) therethrough which is coaxially aligned with said second cylindrical portion of said ink supply channel and which has a diameter between about 3 and 30 microns and a length which is about 3 to 30 times greater than said diameter, and an ultrasonic vibration element mounted to said housing at a location adjacent said outlet end.

2. The inkjet nozzle as defined in claim 1 wherein the axial length of said first cylindrical portion of said ink supply channel is greater than the axial length of said second cylindrical portion thereof.

3. The inkjet nozzle as defined in claim 1 further comprising a filter mounted in said ink supply channel.

4. An inkjet nozzle for an inkjet printer comprising a housing (1) made of an essentially undeformable material and defining an inlet end (3) and an opposite outlet end (4), an ink supply channel (2) extending through said housing and between said inlet and said outlet end, said ink supply channel including a cylindrical portion adjacent said outlet end, said cylindrical portion of said ink supply channel having a diameter which is between about 0.2 to 1 mm, a separate thin flat plate (7) fixed to said outlet end of said housing so as to close said cylindrical portion of said ink supply channel, said plate including an outflow channel (8) therethrough which is coaxially aligned with said cylindrical portion of said ink supply channel and which has a diameter between about 3 and 30 microns and a length which is about 3 to 30 times greater than said diameter, and an ultrasonic vibration element (12) mounted to said housing at a location adjacent said outlet end.

5. An inkjet nozzle according to claim 4 wherein the diameter of said outflow channel (8) is between about 6 and 20 microns, and the length of said outflow channel is between about 4 to 20 times greater than said diameter.

6. Inkjet nozzle according to claim 4 wherein the diameter of said outflow channel (8) is essentially uniform along the length of said outflow channel.

7. An inkjet nozzle according to claim 4 wherein said housing (1) comprises a metal.

8. An inkier nozzle according to claim 4 further comprising adhesive means for bonding said plate (7) to said housing (1).

9. An inkjet nozzle according to claim 4 wherein said ultrasonic vibration element (12) is disposed adjacent and parallel to said ink supply channel (2).

10. An inkjet nozzle according to claim 9 wherein said ultrasonic vibration element (12) is fixed with adhesive in a recess in said housing (1).

* * * * *

UNITED STATES PATENT AND TRADEMARK OFFICE

CERTIFICATE OF CORRECTION

PATENT NO. : 5,491,499

DATED : February 13, 1996

INVENTOR(S) : Christiaan P.M. Bibbe, et al.

It is certified that error appears in the above-indentified patent and that said Letters Patent is hereby corrected as shown below:

Column 2, line 47, delete "Greater" and insert --greater-- therefor.

Column 2, line 57, after "drop" omit the comma (,).

Column 2, line 58, after "formation" insert --In the preferred embodiment, the outflow channel 8 has a length/diameter ratio which lies between 3 and 30, and preferably lies between 4 and 20.--

Column 3, line 32, after "plate 7" insert --is--.

Column 4, line 9, delete "snort" and insert --short-- therefor.

UNITED STATES PATENT AND TRADEMARK OFFICE

CERTIFICATE OF CORRECTION

PATENT NO. : 5,491,499

DATED : February 13, 1996

INVENTOR(S) : Christiaan P.M. Bibbe, et al

It is certified that error appears in the above-indentified patent and that said Letters Patent is hereby corrected as shown below:

Column 4, line 11, after "cleaning" insert --)-- (parenthesis) and delete "D".

Column 4, line 30, after "channel," insert --if--.

Column 6, line 10, delete "inkier" and insert --inkjet-- therefor.

Signed and Sealed this

Seventh Day of January, 1997

Bruce Lehman

*Attest:*

BRUCE LEHMAN

*Attesting Officer*

*Commissioner of Patents and Trademarks*